US008402768B2

(12) United States Patent
Syed et al.

(10) Patent No.: US 8,402,768 B2
(45) Date of Patent: Mar. 26, 2013

(54) REHEAT BURNER INJECTION SYSTEM

(75) Inventors: Khawar Syed, Oberrohrdorf (CH); Madhavan Poyyapakkam, Rotkreuz (CH); Anton Winkler, Olching (DE); Andre Theuer, Baden (CH)

(73) Assignee: Alstom Technology Ltd., Baden (CH)

( * ) Notice: Subject to any disclaimer, the term of this patent is extended or adjusted under 35 U.S.C. 154(b) by 0 days.

(21) Appl. No.: 13/465,898

(22) Filed: May 7, 2012

(65) Prior Publication Data

US 2012/0272659 A1 Nov. 1, 2012

Related U.S. Application Data

(63) Continuation of application No. PCT/EP2010/066522, filed on Oct. 29, 2010.

(30) Foreign Application Priority Data

Nov. 7, 2009 (CH) ..... 1889/09

(51) Int. Cl.
*F02C 3/10* (2006.01)
*F02C 6/00* (2006.01)

(52) U.S. Cl. ..... 60/791; 60/740; 60/737; 60/742; 60/748; 431/8; 431/9; 431/181; 431/185; 431/354

(58) Field of Classification Search ..... 60/791, 60/737, 740, 742, 748, 39.17, 761, 762, 39.463; 431/8, 9, 181, 185, 354
See application file for complete search history.

(56) References Cited

U.S. PATENT DOCUMENTS

| | | | | |
|---|---|---|---|---|
| 580,360 | A | 4/1897 | Bachy | |
| 2,478,851 | A | 8/1949 | Traupel | |
| 3,373,567 | A | 3/1968 | Palfreyman et al. | |
| 3,620,012 | A | 11/1971 | Wilde | |
| 4,830,315 | A * | 5/1989 | Presz et al. | 244/200 |

(Continued)

FOREIGN PATENT DOCUMENTS

| | | |
|---|---|---|
| EP | 0 473 371 A1 | 3/1992 |
| EP | 0 911 585 A1 | 4/1999 |

(Continued)

OTHER PUBLICATIONS

International Search Report (PCT/ISA/210) issued on Jan. 20, 2011, by the European Patent Office as the International Searching Authority for International Application No. PCT/EP2010/066522.

(Continued)

*Primary Examiner* — William H Rodriguez
*Assistant Examiner* — Craig Kim
(74) *Attorney, Agent, or Firm* — Buchanan Ingersoll & Rooney PC

(57) ABSTRACT

The disclosure relates to a burner for a combustion chamber of a gas turbine, with an injection device for the introduction of at least one gaseous and/or liquid fuel into the burner, wherein the injection device has at least one body which is arranged in the burner with at least one nozzle for introducing the at least one fuel into the burner, the at least one body being configured as a streamlined body which has a streamlined cross-sectional profile and which extends with a longitudinal direction perpendicularly or at an inclination to a main flow direction prevailing in the burner. The at least one nozzle has its outlet orifice at or in a trailing edge of the streamlined body, and with reference to a central plane of the streamlined body, the trailing edge is provided with at least two lobes extending in opposite transverse directions.

20 Claims, 5 Drawing Sheets

U.S. PATENT DOCUMENTS

| | | | | |
|---|---|---|---|---|
| 4,887,425 | A | 12/1989 | Vdoviak | |
| 4,932,861 | A | 6/1990 | Keller et al. | |
| 5,203,796 | A | 4/1993 | Washam et al. | |
| 5,235,813 | A * | 8/1993 | McVey et al. | 60/737 |
| 5,251,447 | A | 10/1993 | Joshi et al. | |
| 5,297,391 | A | 3/1994 | Roche | |
| 5,315,815 | A | 5/1994 | McVey et al. | |
| 5,351,477 | A | 10/1994 | Joshi et al. | |
| 5,423,608 | A | 6/1995 | Chyou et al. | |
| 5,431,018 | A | 7/1995 | Keller et al. | |
| 5,433,596 | A | 7/1995 | Dobbeling et al. | |
| 5,487,659 | A | 1/1996 | Eroglu et al. | |
| 5,511,375 | A | 4/1996 | Joshi et al. | |
| 5,513,982 | A | 5/1996 | Althaus et al. | |
| 5,593,302 | A | 1/1997 | Althaus et al. | |
| 5,622,054 | A * | 4/1997 | Tingle | 60/737 |
| 5,626,017 | A | 5/1997 | Sattelmayer | |
| 5,638,682 | A | 6/1997 | Joshi et al. | |
| 5,647,200 | A | 7/1997 | Althaus | |
| 5,735,126 | A | 4/1998 | Schulte-Werning | |
| 5,794,449 | A | 8/1998 | Razdan et al. | |
| 5,813,232 | A | 9/1998 | Razdan et al. | |
| 5,865,024 | A | 2/1999 | Kress et al. | |
| 5,941,064 | A | 8/1999 | Chevalier et al. | |
| 6,082,111 | A | 7/2000 | Stokes | |
| 6,112,516 | A | 9/2000 | Beule et al. | |
| 6,263,660 | B1 | 7/2001 | Lawlor | |
| 6,460,326 | B2 | 10/2002 | Bechtel et al. | |
| 6,795,192 | B2 | 9/2004 | Dickopf et al. | |
| 8,047,001 | B2 | 11/2011 | Beeck et al. | |
| 2002/0038542 | A1 | 4/2002 | Akama et al. | |
| 2002/0187448 | A1 | 12/2002 | Eroglu et al. | |
| 2003/0128364 | A1 | 7/2003 | Dickopf et al. | |
| 2006/0016192 | A1 | 1/2006 | Bunel et al. | |
| 2006/0230764 | A1 | 10/2006 | Schmotolocha et al. | |
| 2007/0033945 | A1 | 2/2007 | Goldmeer et al. | |
| 2008/0078182 | A1 | 4/2008 | Evulet | |
| 2009/0081048 | A1 | 3/2009 | Beeck et al. | |
| 2010/0300109 | A1 | 12/2010 | Carroni et al. | |

FOREIGN PATENT DOCUMENTS

| | | | |
|---|---|---|---|
| EP | 1 434 007 | A2 | 6/2004 |
| EP | 1 619 441 | A1 | 1/2006 |
| EP | 1 752 709 | A2 | 2/2007 |
| EP | 1 257 809 | B1 | 10/2007 |
| EP | 1 847 696 | A1 | 10/2007 |
| EP | 2 072 899 | A1 | 6/2009 |
| GB | 2 216 999 | A1 | 10/1989 |
| GB | 2 293 001 | A | 3/1996 |
| JP | 54-121425 | A | 9/1979 |
| WO | WO 00/19081 | A2 | 4/2000 |

OTHER PUBLICATIONS

Written Opinion (PCT/ISA/237) issued on Jul. 14, 2011, by the European Patent Office as the International Searching Authority for International Application No. PCT/EP2010/066522.

Swiss Search Report issued on Apr. 7, 2010 for Swiss Application No. 1889/2009.

International Search Report (PCT/ISA/210) issued on Jul. 14, 2011, by the European Patent Office as the International Searching Authority for International Application No. PCT/EP2010/066497.

Written Opinion (PCT/ISA/237) issued on Jul. 14, 2011, by the European Patent Office as the International Searching Authority for International Application No. PCT/EP2010/066497.

Swiss Search Report issued on May 12, 2010 for Swiss Application No. 1887/2009.

International Search Report (PCT/ISA/210) issued on Jun. 4, 2011, by the European Patent Office as the International Searching Authority for International Application No. PCT/EP2010/066513.

Written Opinion (PCT/ISA/237) issued on Jun. 4, 2011, by the European Patent Office as the International Searching Authority for International Application No. PCT/ EP2010/066513.

Swiss Search Report issued on May 12, 2010 for Swiss Application No. 1888/2009.

International Search Report (PCT/ISA/210) issued on Jul. 14, 2011, by the European Patent Office as the International Searching Authority for International Application No. PCT/EP2010/066395.

Written Opinion (PCT/ISA/237) issued on Jul. 14, 2011, by the European Patent Office as the International Searching Authority for International Application No. PCT/ EP2010/066395.

Swiss Search Report issued on May 12, 2010 for Swiss Application No. 1886/2009.

International Search Report (PCT/ISA/210) issued on Jan. 20, 2011, by the European Patent Office as the International Searching Authority for International Application No. PCT/EP2010/066535.

Written Opinion (PCT/ISA/237) issued on Jan. 20, 2011, by the European Patent Office as the International Searching Authority for International Application No. PCT/ EP2010/066535.

Swiss Search Report issued on Apr. 6, 2010 for Swiss Application No. 1890/2009.

Office Action issued on Nov. 2, 2012 by the U.S. Patent and Trademark Office in corresponding U.S. Appl. No. 13/465,965.

* cited by examiner

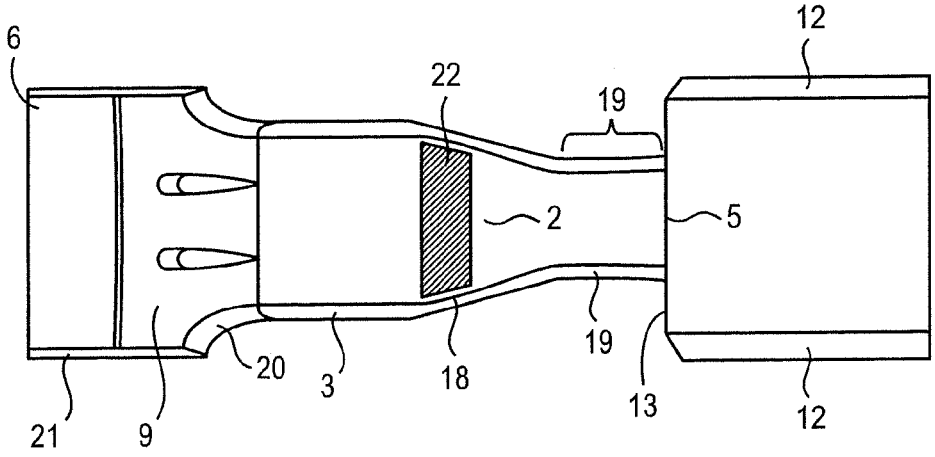
FIG. 3
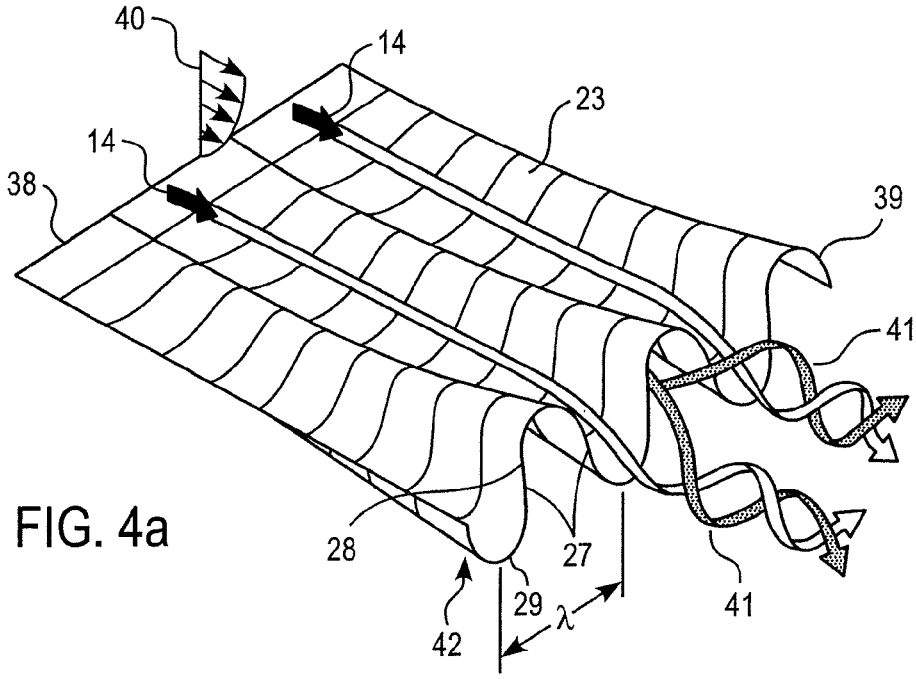
FIG. 4a
FIG. 4b
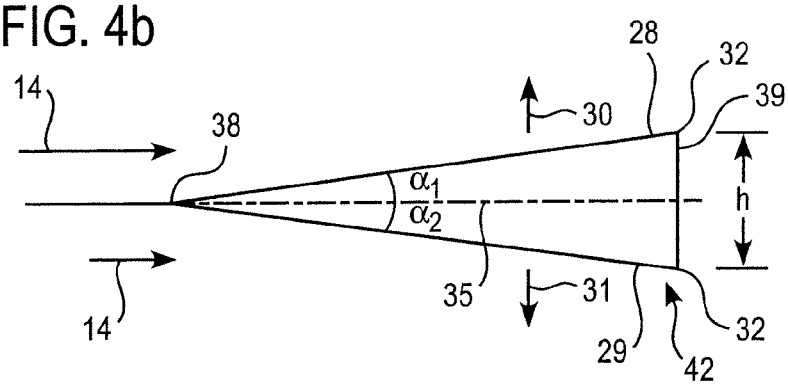

FIG. 5a
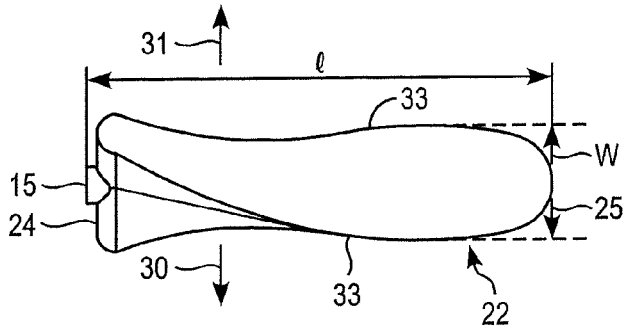
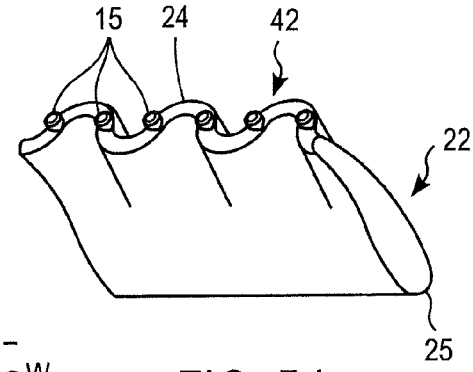
FIG. 5d
FIG. 5b
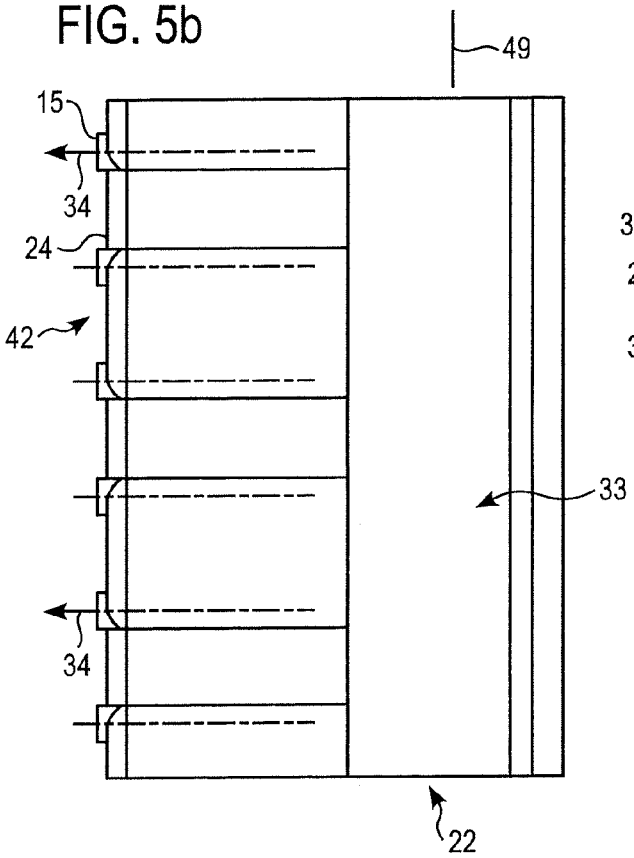
FIG. 5c
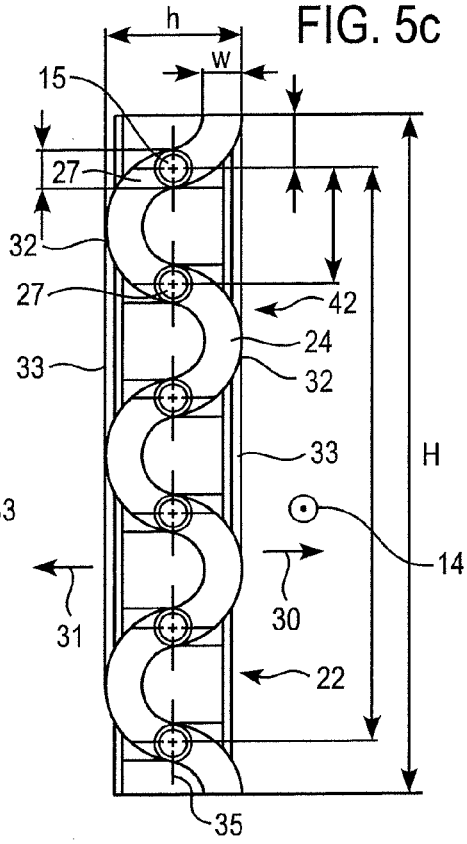

REHEAT BURNER INJECTION SYSTEM

RELATED APPLICATION

This application claims priority as a continuation application under 35 U.S.C. §120 to PCT/EP2010/066522, which was filed as an International Application on Oct. 29, 2010 designating the U.S., and which claims priority to Swiss Application 01889/09 filed in Switzerland on Nov. 7, 2009. The entire contents of these applications are hereby incorporated by reference in their entireties.

FIELD

A burner is disclosed for a combustion chamber of a gas turbine, such as a secondary combustion chamber with sequential combustion having first and secondary combustion chambers, and with an injection device for the introduction of at least one gaseous and/or liquid fuel into the burner.

BACKGROUND INFORMATION

In order to achieve high efficiency, a high turbine inlet temperature is used in standard gas turbines. As a result, there can arise high NOx emission levels and higher life cycle costs. This can be mitigated with a sequential combustion cycle, wherein the compressor delivers nearly double the pressure ratio of a conventional one. The main flow passes the first combustion chamber (e.g. using a burner of the general type as disclosed in EP 1 257 809 or as in U.S. Pat. No. 4,932,861, also called EV combustor, where the EV stands for environmental), wherein a part of the fuel is combusted. After expanding at the high-pressure turbine stage, the remaining fuel is added and combusted (e.g. using a burner of the type as disclosed in U.S. Pat. Nos. 5,431,018 or 5,626,017 or in US 2002/0187448, also called SEV combustor, where the S stands for sequential). Both combustors contain premixing burners, as low NOx emissions involve high mixing quality of the fuel and the oxidizer.

Since the second combustor is fed by expanded exhaust gas of the first combustor, the operating conditions allow self ignition (spontaneous ignition) of the fuel air mixture without additional energy being supplied to the mixture. To prevent ignition of the fuel air mixture in the mixing region, the residence time therein should not exceed the auto ignition delay time. This criterion can ensure flame-free zones inside the burner. This criterion can pose challenges in obtaining appropriate distribution of the fuel across the burner exit area.

SEV-burners are currently designed for operation on natural gas and oil only. Therefore, the momentum flux of the fuel is adjusted relative to the momentum flux of the main flow so as to penetrate in to the vortices. This is done by using air from the last compressor stage (high-pressure carrier air). The high-pressure carrier air is bypassing the high-pressure turbine. The subsequent mixing of the fuel and the oxidizer at the exit of the mixing zone is just sufficient to allow low NOx emissions (mixing quality) and avoid flashback (residence time), which may be caused by auto ignition of the fuel air mixture in the mixing zone.

SUMMARY

A burner for a combustion chamber of a gas turbine is disclosed, comprising: an injection device for the introduction of at least one gaseous and or liquid fuel into the burner, wherein the injection device has at least one body which is arranged in the burner with at least one nozzle for introducing the at least one fuel into the burner, the at least one body being configured as a streamlined body which has a streamlined cross-sectional profile and which extends with a longitudinal direction perpendicularly or at an inclination to a main flow direction prevailing in the burner, the at least one nozzle having its outlet orifice at or in a trailing edge of the streamlined body; and, with reference to a central plane of the streamlined body, the trailing edge is provided with at least two lobes extending in opposite transverse directions.

BRIEF DESCRIPTION OF THE DRAWINGS

Exemplary embodiments are described in the following with reference to the drawings, which are for the purpose of illustrating the exemplary embodiments and not for the purpose of limiting the same. In the drawings:

FIG. 3 shows an exemplary secondary burner located downstream of the high-pressure turbine with reduced exit cross-section area;

FIG. 4 shows in a) a schematic perspective view onto a lobed elements and the flow paths generated on both sides and at the trailing edge thereof, and in b) a side elevation view thereof;

FIG. 5 shows a lobed flute according to an exemplary embodiment, wherein in a) a cut perpendicular to the longitudinal axis is shown, in b) a side view, in c) a view onto the trailing edge and against the main flow, and in d) a prospective view;

DETAILED DESCRIPTION

Figure 1:
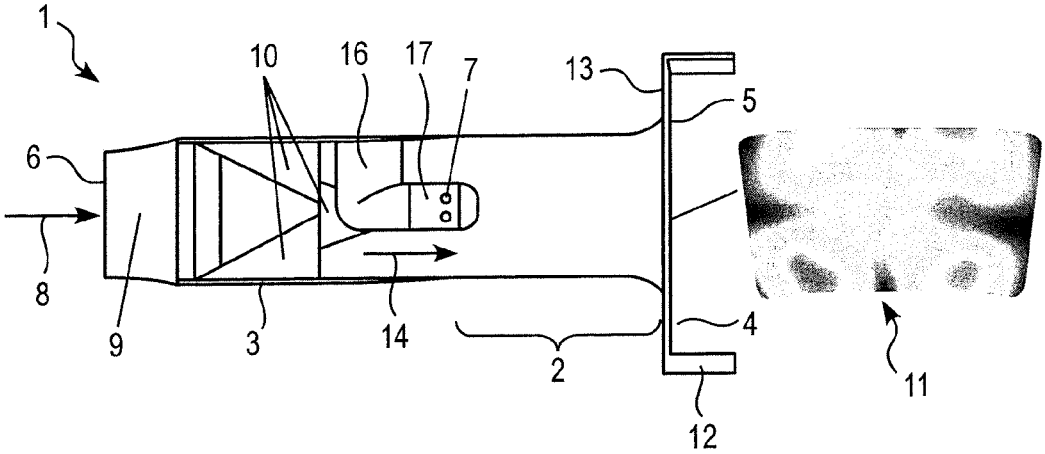
FIG. 1 shows an exemplary secondary burner located downstream of the high-pressure turbine together with the fuel mass fraction contour (left side) at the exit of the burner.

An improved burner is disclosed, such as for high reactivity conditions (e.g., for a situation where the inlet temperature of a secondary burner is higher than reference, and/or for a situation where high reactivity fuels, specifically MBtu fuels, shall be burned in such a secondary burner).

Modifications to an injection lance are proposed to increase the gas turbine engine efficiency, to increase the fuel capability, as well as to simplify the design.

A burner, is disclosed, such as for a secondary combustion chamber of a gas turbine with sequential combustion having a first and a second combustion chamber, with an injection device for the introduction of at least one gaseous and/or liquid fuel into the burner, wherein the injection device has at least one body which is arranged in the burner with at least one nozzle for introducing the at least one fuel into the burner. The at least one body is configured as a streamlined body which has a streamlined cross-sectional profile and which extends with a longitudinal direction perpendicularly or at an inclination to a main flow direction prevailing in the burner. The at least one nozzle has its outlet orifice at or in a trailing edge (or somewhat downstream of the trailing edge) of the streamlined body. A streamlined body can be formed such that with reference to a central plane of the streamlined body the trailing edge is provided with at least two lobes in opposite transverse directions.

In other words the trailing edge does not form a straight line but a wavy or sinusoidal line, where this line oscillates around the central plane. The lobes therefore alternatingly extend out that the central plane, so alternatingly in the transverse direction with respect to the central plane. The shape can, for example, be a sequence of semi-circles, or it can be a sinus or sinusoidal form, or can be in the form of a zig-zag with rounded edges. The lobes can be of essentially the same shape along the trailing edge. The lobes are arranged adjacent to each other so that they form an interconnected trailing edge line. The lobe angles should be chosen in such a way that flow separation is avoided.

According to exemplary embodiments, injection of fuel can occur at the trailing edge of the lobed injectors. The fuel injection can, for example, be along the axial direction, which eliminates the need for high-pressure carrier air.

Exemplary embodiments allow fuel-air mixing with low momentum flux ratios being possible. An inline fuel injection system includes a number of lobed flutes staggered to each other.

Exemplary embodiments can save pressure losses by an innovative injector design. Exemplary advantages are as follows:

1. Increased GT efficiency:

A: The overall GT efficiency increases. The cooling air bypasses the high-pressure turbine, but it is compressed to a lower pressure level compared to normally necessary high-pressure carrier air and does not need to be cooled down.

B: Lobes can be shaped to produce appropriate flow structures. Intense shear of the vortices helps in rapid mixing and avoidance of low velocity pockets. An aerodynamically favored injection and mixing system reduces the pressure drop even further. Due to only having one device (injector) rather than the separate elements i) large-scale mixing device at the entrance of the burner, ii) vortex generators on the injector, iii) injector, pressure is saved. The savings can be utilized in order to increase the main flow velocity. This is beneficial if it comes to fuel air mixtures with high reactivity.

2. The fuel may be injected in-line at exactly (or near) the location where vortices are generated. The design of the cooling air passage can be simplified, as the fuel does not require momentum from high-pressure carrier air anymore.

Exemplary embodiments can merge the vortex generation aspect and known use of a fuel injection device as separate elements (separate structural vortex generator element upstream of separate fuel injection device) into one single combined vortex generation and fuel injection device. By doing this, mixing of fuels with oxidation air and vortex generation take place in very close spatial vicinity and very efficiently, such that more rapid mixing is possible and the length of the mixing zone can be reduced. It is even possible in some cases, by corresponding design and orientation of the body in the oxidizing air path, to omit the flow conditioning elements (turbine outlet guide vanes) as the body may also take over the flow conditioning. All this is possible without severe pressure drop along the injection device such that the overall efficiency of the process can be maintained.

According to an exemplary embodiment, the trailing edge is provided with at least 3 (e.g., at least 4) lobes sequentially arranged one adjacent to the next along the trailing edge and alternatingly lobing in the two opposite transverse directions.

A further exemplary embodiment is characterised in that the streamlined body includes an essentially straight leading edge. The leading edge may however also be rounded, bent or slightly twisted, or other suitable shape.

According to a further exemplary embodiment, the streamlined body, in its straight upstream portion with respect to the main flow direction, has a maximum width W. Downstream of this width W, the width (e.g., the distance between the lateral sidewalls defining the streamlined body), essentially continuously diminishes towards the trailing edge (e.g., the trailing edge either forming a sharp edge or rounded edge). The height h, defined as the distance in the transverse direction of the apexes of adjacent lobes, is in this case, for example, at least half of the maximum width. According to an exemplary embodiment, this height h is approximately the same as the maximum width of the streamlined body. According to another exemplary embodiment, this height h is approximately twice the maximum width of the streamlined body. Generally speaking, the height h is, for example, at least as large as the maximum width W, and for example, not more than three times as large as the maximum width W.

For applications such as gas turbine applications, the streamlined body has a height H along its longitudinal axis (perpendicular to the main flow) in the range of, for example, 100-200 mm. For example, under the circumstances, the lobe periodicity ("wavelength") $\lambda$ is preferentially in the exemplary range of 20-100 mm, for example, in the range of 30-60 mm. This means that along the trailing edge there are located six alternating lobes, three in each transverse direction.

According to a further exemplary embodiment, the transverse displacement of the streamlined body forming the lobes is only at most in the downstream two thirds of the length l (measured along the main flow direction) of the streamlined body. This means that in the upstream portion the streamlined body has an essentially symmetric shape with respect to the central plane which does not change along the longitudinal axis. Downstream thereof the lobes are continuously and smoothly growing into each transverse direction forming a wavy shape of the sidewalls of the streamlined body where the amplitude of this wavy shape is increasing the maximum value at the trailing edge. For example, only the downstream half of the length l of the streamlined body contributes to the lobing.

According to yet another exemplary embodiment, at least two, for example, at least three, more preferably, for example, at least four or five fuel nozzles are located at the trailing edge and distributed (e.g., in equidistant manner) along the trailing edge.

According to yet another exemplary embodiment, the fuel nozzles are located essentially on the central plane of the streamlined body (and not in the lobed portions of the trailing edge). In this case, for example, at each position or every second position along the trailing edge, where the lobed trailing edge crosses the central plane, there can be a fuel nozzle.

According to yet another exemplary embodiment, the fuel nozzles are located essentially at the turning points between two lobes, wherein for example at each turning point or at every second turning point along the trailing edge there is located a fuel nozzle.

Such a burner can be bordered by burner sidewalls. For example, the sidewalls are essentially planar wall structures, which can be converging towards the exit side. For example, those sidewalls which are essentially parallel to the main axis of the lobed injection device(s) can, in accordance with yet another exemplary embodiment, also be lobed so they can have an undulated surface. This undulation can, for example, follow essentially the same characteristics as the one of the injectors (e.g., the undulation can have the same periodicity, and or the undulation may be arranged in phase with the undulations of the injectors. It may also have essentially the same height of the undulations as the height of the lobes of the injectors. So it is possible to have a structure, in which one lobed injector is bordered by at least one (e.g., two) lateral sidewalls of the combustion chamber which have the same undulation characteristics, so that the flow path as a whole has the same lateral width as a function of the height. In other words the lateral distance between the sidewall and the trailing edge of the injector is essentially the same for all positions when going along the longitudinal axis of the injector.

In case of several essentially parallel arranged injectors within the same flow path the lobes of these injectors are for example, arranged in phase, such that the lateral distance between their trailing edges is the same irrespective of the height. This can be combined with in phase undulations of the sidewalls of the combustion chamber.

Downstream of the body (such as downstream of a group of, for example, three of such bodies located within the same burner) a mixing zone is located, and/or downstream of the body the cross-section of the mixing zone is reduced, wherein this reduction is, for example, at least 10% (e.g., at least 20% or at least 30%), compared to the flow cross-section upstream of the body.

For example, at least the nozzle inject fuel (liquid or gas) and/or carrier gas are parallel to the main flow direction. The at least one nozzle may however also inject fuel and/or carrier gas at an inclination angle of, for example, normally not more than 30° with respect to the main flow direction.

The streamlined body can extend across the entire flow cross section between opposite walls of the burner.

Further, the burner can be a burner comprising at least two (e.g., at least three) streamlined bodies, the longitudinal axes of which are arranged essentially parallel to each other. In an exemplary embodiment, only the central streamlined body has its central plane arranged essentially parallel to the main flow direction, while the two outer streamlined bodies are slightly inclined converging towards the mixing zone if, for example, the mixing zone has the same converging shape.

According to an exemplary embodiment, the body is provided with cooling elements, wherein these cooling elements can be given by internal circulation of cooling medium along the sidewalls of the body (e.g., by providing a double wall structure) and/or by film cooling holes, located, for example, near the trailing edge, and wherein the cooling elements can be fed with air from the carrier gas feed also used for the fuel injection.

The fuel can be injected from the nozzle together with a carrier gas stream, and the carrier gas air can be low pressure air with a pressure in the range of 10-25 bar (e.g., in the range of 16-22 bar).

The streamlined body can, for example, have a cross-sectional profile which, in the portion where it is not lobed, is mirror symmetric with respect to the central plane of the body.

The streamlined body can be arranged in the burner such that a straight line connecting the trailing edge to a leading edge extends parallel to the main flow direction of the burner.

A plurality of separate outlet orifices of a plurality of nozzles can be arranged next to one another and arranged at the trailing edge.

At least one slit-shaped outlet orifice can be, in the sense of a nozzle, arranged at the trailing edge.

Furthermore the use of a burner as defined above is disclosed for the combustion under high reactivity conditions, such as for the combustion at high burner inlet temperatures and/or for the combustion of MBtu fuel with, for example, a calorific value of 5000-20,000 kJ/kg (e.g., 7000-17,000 kJ/kg, or preferably 10,000-15,000 kJ/kg, most preferably such a fuel comprising hydrogen gas).

Several design modifications to the existing secondary burner (SEV) designs are proposed to introduce a low pressure drop complemented by rapid mixing for highly reactive fuels and operating conditions. According to exemplary embodiments, fuel-air mixing can be accomplished within short burner-mixing lengths. Exemplary embodiments include aerodynamically facilitated axial fuel injection with mixing promoted by small sized vortex generators. Further performance benefit can be achieved with elimination/replacement of high-pressure and more expensive carrier air with low pressure carrier air. As a result, the burner is designed to operate at increased SEV inlet temperature or fuel flexibility without suffering on high NOx emissions or flashback.

Exemplary key advantages can be summarized as follows:

- Higher burner velocities to accommodate highly reactive fuels.
- Lower burner pressure drop for similar mixing levels achieved with current designs
- SEV operable at higher inlet temperatures.
- Possibility to remove or replace high-pressure carrier air with low pressure carrier air.

With respect to performing a reasonable fuel air mixing, the following components of current burner systems are of interest:

- At the entrance of the SEV combustor, the main flow must be conditioned in order to guarantee uniform inflow conditions independent of the upstream disturbances, e.g. caused by the high-pressure turbine stage.
- Then, the flow must pass four vortex generators.
- For the injection of gaseous and liquid fuels into the vortices, fuel lances are used, which extend into the mixing section of the burner and inject the fuel(s) into the vortices of the air flowing around the fuel lance.

To this end FIG. 1 shows a known secondary burner 1. The burner, which is an annular burner, is bordered by opposite walls 3. These opposite walls 3 define the flow space for the flow 14 of oxidizing medium. This flow enters as a main flow 8 from the high pressure turbine (e.g., behind the last row of rotating blades of the high pressure turbine which is located downstream of the first combustor). This main flow 8 enters the burner at the inlet side 6. First this main flow 8 passes flow conditioning elements 9, which can be turbine outlet guide vanes which are stationary and bring the flow into the proper orientation. Downstream of these flow conditioning elements 9 vortex generators 10 are located in order to prepare for the subsequent mixing step. Downstream of the vortex generators 10 there is provided an injection device or fuel lance 7 which can include a stem or foot 16 and an axial shaft 17. At the most downstream portion of the shaft 17 fuel injection takes place, in this case fuel injection takes place via orifices which inject the fuel in a direction perpendicular to flow direction 14 (cross flow injection).

Downstream of the fuel lance 7 there is the mixing zone 2, in which the air, bordered by the two walls 3, mixes with the fuel and then at the outlet side 5 exits into the combustion chamber or combustion space 4 where self-ignition takes place.

At the transition between the mixing zone 2 to the combustion space 4 there can be a transition 13, which may be in the form of a step, or as indicated here, may be provided with round edges and also with stall elements for the flow. The combustion space is bordered by the combustion chamber wall 12.

This leads to a fuel mass fraction contour 11 at the burner exit 5 as indicated on the right side of FIG. 1.

Figure 2:
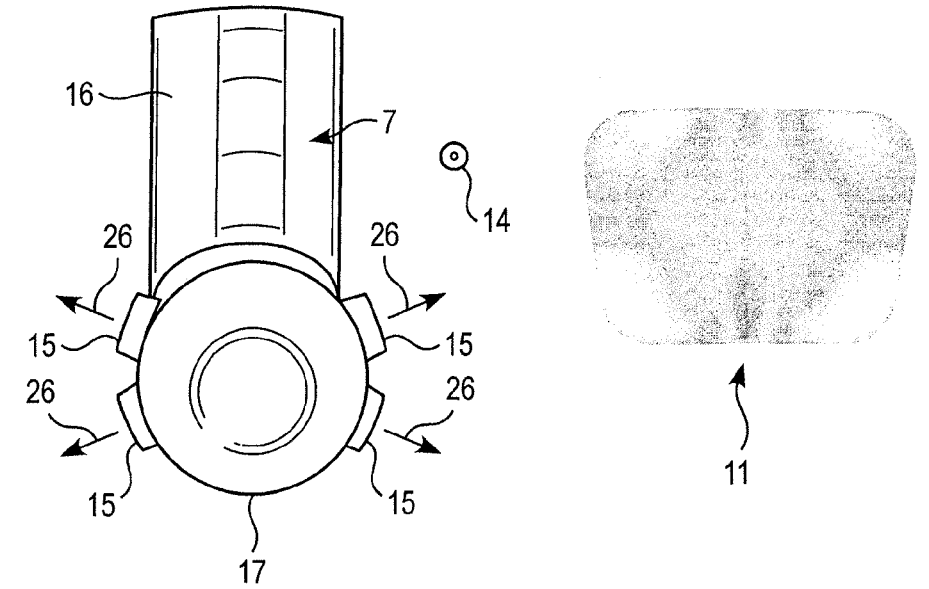
FIG. 2 shows an exemplary secondary burner fuel lance in a view opposite to the direction of the flow of oxidising medium in a) and the fuel mass fraction contour using such a fuel lance at the exit of the burner in b)

In FIG. 2 a second fuel injection is illustrated, here the fuel lance 7 is not provided with known injection orifices but, in addition to their positioning at specific axial and circumferential positions, has circular sleeves protruding from the cylindrical outer surface of the shaft 17 such that the injection of the fuel along injection direction 26 is more efficient as the fuel is more efficiently directed into the vortices generated by the vortex generators 10.

Using a set-up according to FIG. 2*a*, a fuel mass fraction contour according to FIG. 2*b* results.

SEV-burners are currently designed for operation on natural gas and oil only. Therefore, the momentum of the fuel is adjusted relative to the momentum of the main flow so as to penetrate in to the vortices. The subsequent mixing of the fuel and the oxidizer at the exit of the mixing zone is just sufficient to allow low NOx emissions (mixing quality) and avoid flashback (residence time), which may be caused by auto ignition of the fuel air mixture in the mixing zone.

According to exemplary embodiments, burning of fuel air mixtures can be performed with a reduced ignition delay time. This can be achieved by an integrated approach, which allows higher velocities of the main flow and in turn, a lower residence time of the fuel air mixture in the mixing zone. The challenge regarding the fuel injection is twofold with respect to the use of hydrogen rich fuels and fuel air mixtures with high temperatures:

- Hydrogen rich fuels may change the penetration behavior of the fuel jets. The penetration is determined by the cross section areas of the burner and the fuel injection holes, respectively.
- Depending on the type of fuel or the temperature of the fuel air mixture, the reactivity, which can be defined as tign, ref/tign, (i.e. as the ratio of the ignition time of reference natural gas to the ignition time as actually valid), of the fuel air mixture changes.

The conditions which exemplary embodiments can address are those where the reactivity as defined above is above 1 and the flames are auto igniting. The disclosure is however not limited to these conditions.

For each temperature and mixture composition the laminar flame speed and the ignition delay time can change. As a result, hardware configurations should be provided offering a suitable operation window. For each hardware configuration, the upper limit regarding the fuel air reactivity is given by the flashback safety.

In the framework of an SEV burner the flashback risk is increased, as the residence time in the mixing zone exceeds the ignition delay time of the fuel air. Mitigation can be achieved in several different exemplary ways:

- The inclination angle of the fuel can be adjusted to decrease the residence time of the fuel. Herein, various possibilities regarding the design may be considered (e.g. inline fuel injection, such as essentially parallel to the oxidizing airflow), a conical lance shape or a horny lance design.
- The reactivity can be slowed down by diluting the fuel air mixture with nitrogen or steam, respectively.
- De-rating of the first stage can lead to less aggressive inlet conditions for the SEV burner in case of highly reactive fuels. In turn, the efficiency of the overall gas turbine may decrease.
- The length of the mixing zone can be kept constant, if in turn the main flow velocity is increased. However, then normally a penalty on the pressure drop must be taken.
- By implementing more rapid mixing of the fuel and the oxidizer, the length of the mixing zone can be reduced while maintaining the main flow velocity.

Exemplary embodiments include an improved burner configuration, wherein the latter two points are addressed, which however can be combined also with the upper three points.

In order to allow capability for highly reactive fuels, the injector is designed to perform flow conditioning (at least partial),injection and mixing simultaneously. As a result, the injector can save burner pressure loss, which is currently utilized in the various devices along the flow path. If the combination of flow conditioning device, vortex generator and injector is replaced by embodiments as disclosed herein, the velocity of the main flow can be increased in order to achieve a short residence time of the fuel air mixture in the mixing zone.

FIG. 3 shows a set-up, where the proposed burner area is reduced considerably. The higher burner velocities help in operating the burner safely at highly reactive conditions. In FIG. 3 a proposed burner is shown with reduced exit cross-section area. In this case downstream of the inlet side 6 of the burner there is located a flow conditioning element or a row of flow conditioning elements 9 but in this case not followed by vortex generators but then directly followed with a fuel injection device as disclosed herein, which is given as a streamlined body 22 extending with its longitudinal direction across the two opposite walls 3 of the burner. At the position where the streamlined body 22 is located, the two walls 3 converge in a converging portion 18 and narrow down to a reduced burner cross-sectional area 19. This defines the mixing space 2 which ends at the outlet side 5 where the mixture of fuel and air enters the combustion chamber or combustion space 4 which is delimited by walls 12.

FIG. 4 shows the flow conditions along a blade, the central plane 35 of which is arranged essentially parallel to a flow direction of an airflow 14, which has a straight leading edge 38 and a lobed trailing edge 39. The airflow 14 at the leading edge in a situation like that develops a flow profile as indicated schematically in the upper view with the arrows 14.

The lobed structure 42 at the trailing edge 39 is progressively developing downstream the leading edge 38 to a wavy shape with lobes going into a first direction 30, which is transverse to the central plane 35, the lobe extending in that first direction 30 being designated with the reference numeral 28. Lobes extending into a second transverse direction 31 (i.e., in FIG. 4*a* in a downwards direction), are designated with reference numeral 29. The lobes alternate in the two directions and wherever the lobes or rather the line/plane forming the trailing edge hits the central plane 35 there is a turning point 27.

As one can see from the arrows indicated in FIG. 4*a*, the airflow flowing in the channel-like structures on the upper face and the airflows in the channels on the lower face intermingle and start to generate vortexes downstream of the trailing edge 39 leading to an intensive mixing as indicated with reference numeral 41. Theses vortices are, for example, useable for the injection of fuels/air as will be discussed further below.

The lobed structure 42 is defined by the following exemplary parameters:

- the periodicity λ gives the width of one period of lobes in a direction perpendicular to the main flow direction 14;
- the height h is the distance in a direction perpendicular to the main flow direction 14, so along the directions 30 and 31, between adjacent apexes of adjacent lobes as defined in FIG. 4*b;* the first elevation angle $\alpha 1$ which defines the displacement into the first direction of the lobe 28; and the second elevation angle $\alpha 2$ which defines the displacement of lobe 29 in the direction 31 (e.g., $\alpha 1$ can be identical to $\alpha 2$).

This exemplary concept is now applied to flute like injectors for a burner.

FIG. 5 shows the basic design resulting in a flutelike injector. The injector can be part of a burner, as described herein. The main flow is passing the lobed mixer, resulting in velocity gradients. These result in intense generation of shear layers, into which fuel can be injected. The lobe angles are chosen in such way to avoid flow separation.

More specifically, the flute 22 is illustrated in a cut in FIG. 5*a*, in side view in FIG. 5*b*, in a view onto the trailing edge against the main flow direction 14 in FIG. 5*c* and in a perspective view in FIG. 5*d*.

The streamlined body 22 has a leading edge 25 and a trailing edge 24. The leading edge 25 defines a straight line and in the leading edge portion of the shape the shape is essentially symmetric, so in the upstream portion the body has a rounded leading edge and no lobing. The leading edge 25 extends along the longitudinal axis 49 of the flute 22. Downstream of this upstream section the lobes successively and smoothly develop and grow as one goes further downstream towards the trailing edge 24. In this case the lobes are given as half circles sequentially arranged one next to the other alternating in the two opposite directions along the trailing edge, as particularly easily visible in FIG. 5*c*.

At each turning point 27 which is also located on the central plane 35, there is located a fuel nozzle which injects the fuel inline, so essentially along the main flow direction 14. In this case the trailing edge is not a sharp edge but has width w which is in the range of 5 to 10 mm. The maximum width W of the flute element 22 is, for example, in the range of 25-35 mm and the total height h of the lobing is, for example, only slightly larger than this width W.

A blade for an exemplary burner in this case has a height H in the exemplary range of 100-200 mm. The periodicity A is around (e.g., ±10), for example, 40-60 mm.

FIG. 6 shows the lobed flute housed inside a reduced cross sectional area burner. The lobes are staggered in order to improve the mixing performance. The lobe sizes can be varied to optimize both pressure drop and mixing.

Figure 6A:
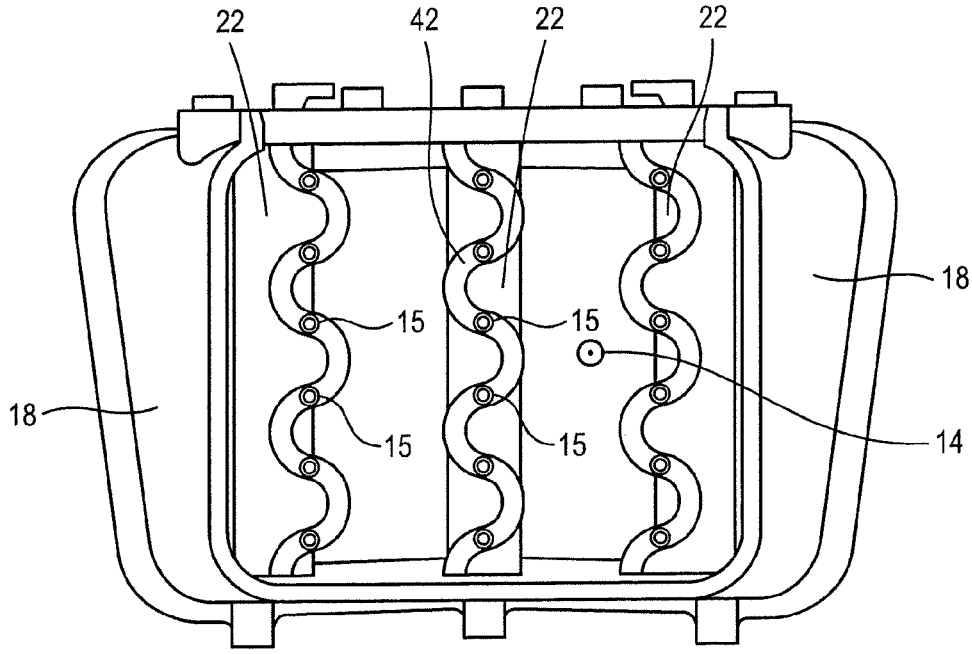
FIG. 6 shows in a view against the main flow direction to different in b)

In FIG. 6*a* a view against the main flow direction 14 in the burner into the chamber where there is the converging portion 18 is shown. Three bodies in the form of lobed injectors 22 are arranged in this cavity and the central body 22 is arranged essentially parallel to the main flow direction, while the two lateral bodies 22 are arranged in a converging manner adapted to the convergence of the two side walls 18.

Top and bottom walls in this case are arranged essentially parallel to each other; they may however also converge towards the mixing section.

In the case of FIG. 6*a* the lobing of the trailing edge is essentially similar to the one as illustrated in FIG. 5.

Figure 6B:
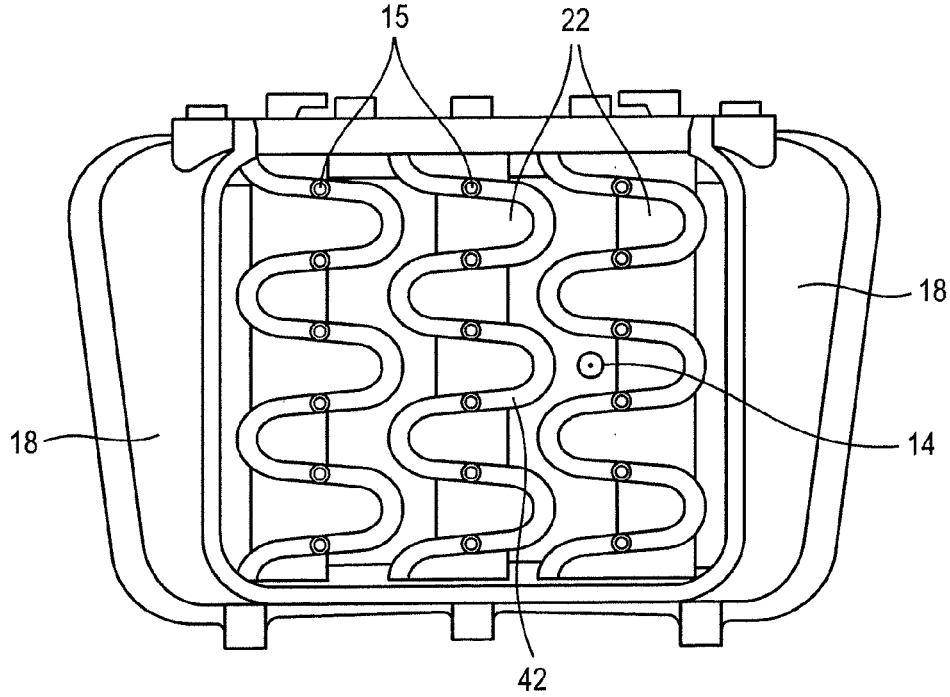

In contrast to this, in FIG. 6*b* a situation is shown, where the lobing is much more pronounced, meaning the height h is much larger compared with the width W of each flute. So in this case, the height h of the lobing is approximately twice the maximum width W of the body 22 at its maximum width position in the upstream portion thereof.

Depending on the desired mixing properties, the height of the lobing can be adapted (also along the trailing edge of one flute the height may vary).

Figure 7A:
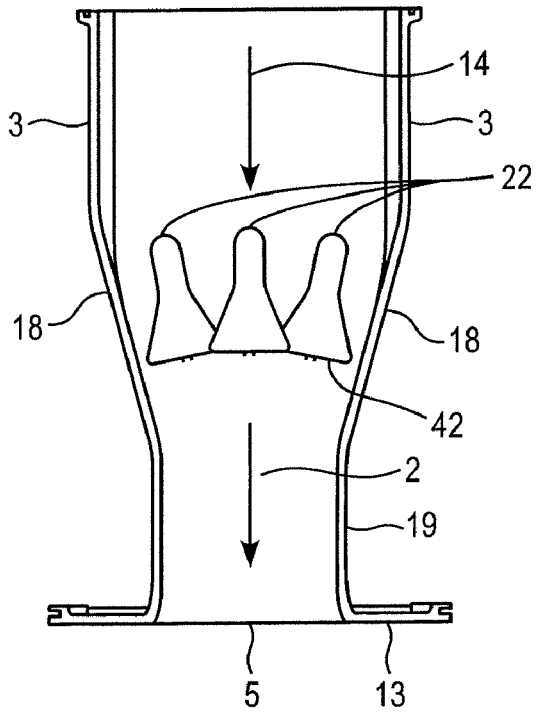
FIG. 7 shows an exemplary burner according to the present disclosure, wherein in a) a top view with removed top cover wall is shown, in b) a perspective view against the main flow direction.
Figure 7B:
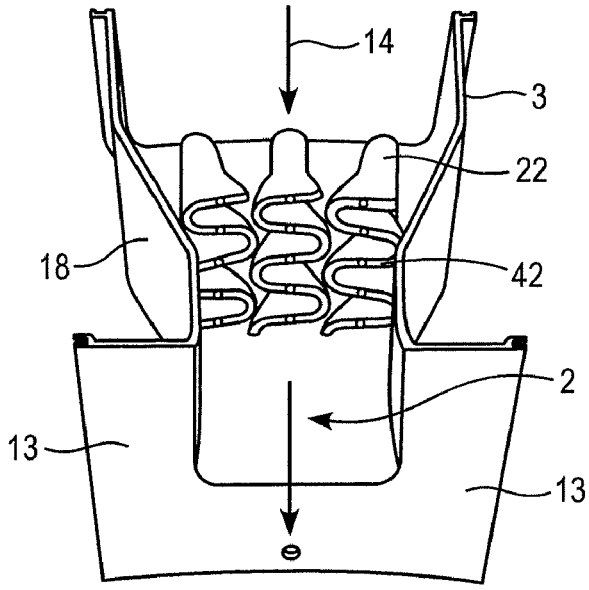

In FIG. 7 a burner similar to the one as illustrated in FIG. 6*b* is given in a top view with the cover wall removed in a and in a perspective view in b. Here the lateral two bodies 22 are arranged in a converging manner so that the flow is smoothly converging into the reduced cross sectional area towards the mixing space 2 bordered by the side wall at the reduced burner cross sectional area 19. At the exit of this area 19, so at the outlet side 5 of the burner, the flame can, for example, be located.

Several exemplary embodiments to the lobed fuel injection system are listed below:

Embodiment 1:

Staggering of lobes to eliminate vortex-vortex interactions. The vortex-vortex interactions result in not effectively mixing the fuel air streams.

Embodiment 2:

Careful placement and location of fuel injection on the lobes: Fuel jets can be placed in the areas of high shear regions in order to best utilize the turbulent dissipation for mixing.

Embodiment 3:

Inclined fuel injection in the lobes: This allows fuel to be injected in to the vortex cores.

Embodiment 4:

Number of flute lobes inside the burner: The flutes can be varied to decide on the strength of the vortices.

Embodiment 5:

Flute lobes acts as inlet flow conditioner: This helps in ensuring the appropriate residence times inside the reheat burner. The lobed flutes can be replaced with current OGVs.

Embodiment 6:

Flute lobes angled inline with the inlet swirl angle of the high-pressure turbine vanes.

Embodiment 7:

Altering the burner cross sectional area to delay flow separation in the lobe passages: The vortex breakdown also needs controlled with burner cross sectional changes.

Embodiment 8:

Fuel staging in the lobed fuel injectors to control emissions and pulsations.

Exemplary advantages of lobed injectors when compared to existing concepts can be summarized as follows:

Better streamlining of hot gas flows to produce strong vortices for rapid mixing and low-pressure drops.

The high speed shearing of fuel mixture can be utilized to control combustor pulsations and flame characteristics.

The lobed flute injector is flexible offering several design variations.

Rapid shear of fuel and air due to lobed structures results in enhanced mixing delivered with shorter burner mixing lengths.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SIGNS

1 burner
2 mixing space, mixing zone
3 burner wall
4 combustion space
5 outlet side, burner exit
6 inlet side
7 injection device, fuel lance

8 main flow from high-pressure turbine
9 flow conditioning, turbine outlet guide vanes
10 vortex generators
11 fuel mass fraction contour at burner exit 5
12 combustion chamber wall
13 transition between 3 and 12
14 flow of oxidising medium
15 fuel nozzle
16 foot of 7
17 shaft of 7
18 converging portion of 3
19 reduced burner cross-sectional area
20 reduction in cross section
21 entrance section of 3
22 streamlined body, flute
23 lobed blade
24 trailing edge of 22
25 leading edge of 22
26 injection direction
27 turning point
28 lobe in first direction 30
29 lobe in second direction 31
30 first transverse direction
31 second transverse direction
32 apex of 28,29
33 lateral surface of 22
34 ejection direction of fuel/carrier gas mixture
35 central plane of 22/23
38 leading edge of 24
39 trailing edge of 23
40 flow profile
41 vortex
42 lobes
49 longitudinal axis of 22
50 central element
λ periodicity of 42
h height of 42
α1 first elevation angle
α2 second elevation angle
l length of 22
H height of 22
w width at trailing edge
W maximum width of 22

What is claimed is:

1. A burner for a combustion chamber of a gas turbine, comprising:

an injection device for the introduction of at least one gaseous and/or liquid fuel into the burner, wherein the injection device has at least one body which is arranged in the burner with at least one nozzle for introducing the at least one fuel into the burner, the at least one body being configured as a streamlined body which has a streamlined cross-sectional profile and which extends with a longitudinal direction perpendicularly or at an inclination to a main flow direction prevailing in the burner, the at least one nozzle having its outlet orifice at or in a trailing edge of the streamlined body; and with reference to a central plane of the streamlined body, the trailing edge is provided with at least two lobes extending in opposite transverse directions.

2. The burner according to claim 1, wherein the trailing edge is provided with at least 3, lobes sequentially arranged adjacent one another along the trailing edge and alternatingly lobing in the two opposite transverse directions.

3. The burner according to claim 1, wherein the streamlined body comprises:

an essentially straight leading edge.

4. The burner according to claim 1, wherein the streamlined body, in its straight upstream portion with respect to the main flow direction, has a maximum width (W) downstream of which the width essentially continuously diminishes towards the trailing edge, and wherein a height (h), defined as a distance in the transverse direction of apexes of adjacent lobes, is at least half of the maximum width (W).

5. The burner according to claim 4, wherein the height (h) is at least as large as the maximum width (W), and not more than three times as large as the maximum width (W).

6. The burner according to claim 1, wherein lobe periodicity (λ) is in the range of 20-100 mm.

7. The burner according to claim 1, wherein a transverse displacement of the streamlined body forming the lobes is only at most in the downstream two thirds of the length (l) of the streamlined body.

8. The burner according to claim 1, comprising:

at least two fuel nozzles located at the trailing edge and distributed along the trailing edge, and wherein the fuel nozzles are located essentially on the central plane of the streamlined body.

9. The burner according to claim 1, comprising:

at least two fuel nozzles located at the trailing edge and distributed along the trailing edge, the fuel nozzles being located essentially at turning points between two lobes, wherein at each turning point along the trailing edge there is a fuel nozzle.

10. The burner according to claim 1, comprising:

downstream of said body, a mixing zone wherein at and/or downstream of said body the cross-section of said mixing zone is reduced by at least 10% compared to the flow cross-section upstream of said body.

11. The burner according to claim 1, wherein at least one nozzle injects fuel and/or carrier gas parallel to the main flow direction.

12. The burner according to claim 1, wherein at least one nozzle injects fuel and/or carrier gas at an inclination angle between 0-30° with respect to the main flow direction.

13. The burner according to claim 1, wherein the streamlined body extends across an entire flow cross section between opposite top and bottom walls of the burner, the burner comprising:

at least two streamlined bodies, the longitudinal axes of which are arranged essentially parallel to each other, and/or wherein the burner is bordered by burner sidewalls arranged essentially parallel to the longitudinal axes of the streamlined bodies, wherein the sidewalls have an undulated surface facing the flow path, and wherein an undulation of the sidewalls has essentially a same periodicity and/or is arranged in phase with lobes of the streamlined bodies and/or have essentially an undulation height which equals a height of the lobes of the streamlined bodies.

14. The burner according to claim 1, wherein the body is provided with cooling elements, wherein these cooling elements are for internal circulation of cooling medium along the sidewalls of the body and/or film cooling holes, located near the trailing edge, and wherein the cooling elements are configured to receive air from a carrier gas feed used for the fuel injection.

15. The burner according to claim 1, wherein the fuel is injected from the nozzle together with a carrier gas stream, and wherein the carrier gas air is low pressure air with a pressure in a range of 10-25 bar.

16. The burner as claimed in claim 1, wherein the streamlined body has a cross-sectional profile which, in a portion where it is not lobed, is mirror symmetric with respect to a central plane of the body.

17. The burner according to claim 1, in combination with a combustion chamber configured for combustion under high reactivity conditions, and/or for combustion at high burner inlet temperatures and/or for combustion of MBtu fuel and/or for combustion of hydrogen rich fuel.

18. The burner according to claim 1, wherein lobe periodicity ($\lambda$) is in a range of 30-60 mm.

19. The burner according to claim 1, wherein a transverse displacement of the streamlined body forming the lobes is only at most in a length (l) of the streamlined body.

20. The burner according to claim 1, comprising:

at least two fuel nozzles located at the trailing edge and distributed along the trailing edge, and wherein at each position, where the lobed trailing edge crosses the central plane, there is a fuel nozzle.

* * * * *